United States Patent [19]

Hoeberechts et al.

[11] Patent Number: 4,574,216

[45] Date of Patent: Mar. 4, 1986

[54] CATHODE-RAY TUBE AND SEMICONDUCTOR DEVICE FOR USE IN SUCH A CATHODE-RAY TUBE

[75] Inventors: Arthur M. E. Hoeberechts; Gerardus G. P. van Gorkom, both of Eindhoven, Netherlands

[73] Assignee: U.S. Philips Corporation, New York, N.Y.

[21] Appl. No.: 713,584

[22] Filed: Mar. 19, 1985

Related U.S. Application Data

[63] Continuation of Ser. No. 422,228, Sep. 23, 1982, abandoned.

[30] Foreign Application Priority Data

Oct. 29, 1981 [NL] Netherlands ..... 8104893

[51] Int. Cl.[4] ..... H01J 29/04

[52] U.S. Cl. ..... 313/444; 313/446; 313/390

[58] Field of Search ..... 313/444, 446, 366, 424, 313/384, 390

[56] References Cited

U.S. PATENT DOCUMENTS

| | | | |
|---|---|---|---|
| 2,835,837 | 5/1958 | Bas-Taymas | 313/424 |
| 4,160,188 | 7/1979 | Butterwick | 313/446 |
| 4,303,930 | 12/1981 | van Gorkom et al. | 357/55 X |
| 4,325,084 | 4/1982 | van Gorkom et al. | 313/446 X |

*Primary Examiner*—Palmer C. DeMeo

*Attorney, Agent, or Firm*—Robert T. Mayer; Steven R. Biren

[57] ABSTRACT

A semiconductor cathode is provided with deflection electrodes, with which a dipole field can be generated. As a result of this, electrons released at the surface of the semiconductor cathode leave the surface at a certain angle. For use inter alia in camera tubes, display tubes, such an inclined beam can be aligned without any problems. Positive ions which are released inter alia from residual gases and are accelerated in the direction of the cathode impinge on the cathode at an acute angle. As a result of this, the active part of the cathode is substantially not attacked by said positive ions, so that degradation is prevented.

13 Claims, 7 Drawing Figures

CATHODE-RAY TUBE AND SEMICONDUCTOR DEVICE FOR USE IN SUCH A CATHODE-RAY TUBE

This is a continuation of application Ser. No. 422,228, filed Sept. 23, 1982, now abandoned.

BACKGROUND OF THE INVENTION

The invention relates to a device for recording or displaying pictures, comprising a cathode-ray tube having, in an evacuated envelope, a target and a semiconductor cathode having a semiconductor body with a major surface on which a first electrically insulating layer having at least an aperture is provided. The semiconductor body comprises at least a pn-junction in which by applying a voltage in the reverse direction across the pn-junction electrons can be generated in the semiconductor body by avalanche multiplication which emanate from the semiconductor body at the area of the aperture in the first electrically insulating layer and in which at least an accelerating electrode is present on the first insulating layer at least at the area of the edge of the aperture in said layer.

Such a device is known from Netherlands patent application No. 7905470 laid open to public inspection on Jan. 15, 1981.

The invention relates in addition to a device for recording or displaying pictures, comprising a cathode-ray tube having in an evacuated envelope a target and a semiconductor cathode having a semiconductor body with at a major surface a p-type surface zone provided with at least two connections of which at least one is an injecting connection at a distance from the major surface which is at most equal to the diffusion recombination length of electrons in the p-type surface zone.

Such a device is known in Dutch Pat. No. 150,609 published on Aug. 16, 1976 (corresponding to British Pat. No. 1,147,883).

In addition, the invention relates to a semiconductor device for use in such a device.

In a device for recording pictures, the cathode-ray tube is a camera tube and the target is a photosensitive layer, for example a photoconductive layer. In a device for recording pictures, the cathode-ray tube may be a display tube, while the target comprises a layer or a pattern of lines or spots of fluorescent material. Such a device may also be designed for electronlithographic or electronmicroscopic uses.

In Netherlands Patent publication No. 7905470, a cathode-ray tube is shown having a so-called "cold cathode". The operation of this cathode is based on the emanation of electrons from a semiconductor body in which a pn-junction is operated in the reverse direction in such manner that avalanche multiplication of charge carriers occurs. Some electrons may obtain so much kinetic energy as is necessary to surpass the electron work function; these electrons are then released at the major surface of the semiconductor body and thus provide an electron current.

Emanation of electrons is facilitated in the device shown by providing the cathode with so-called accelerating electrodes on an insulation layer present at the major surface which do not cover a (slot-shaped, annular, circular, rectangular) aperture in the insulating layer. In order to further facilitate the emanation of electrons the semiconductor surface is provided, as desired, with an electron work function-reducing material, for example caesium.

Because residual gases always remain in the evacuated envelope, negative and positive ions are liberated from said residual gases by the electron current. The negative ions are accelerated in the direction of the target. In the case of electrostatic deflection they may be incident on a small area of the target and damage same or disturb its operation. In order to prevent this detrimental effect, ion traps are used. An ion trap for negative ions is known, for example, from U.S. Pat. No. 2,913,612.

Under the influence of accelerating and focusing fields prevailing in the tube, a part of the positive ions move in the direction of the cathode. When no special measures are taken, a part thereof will be incident on the semiconductor and damage the same in that a kind of ion-etching takes place.

This damage may involve a gradual etching away of the electron work function-reducing material. By a redistribution or even total disappearance of this material the emission properties of the cathode vary. When said layer is not present (or is removed entirely by the abovementioned etching mechanism) even the major surface of the semiconductor body may be attacked. In a semiconductor cathode based on avalanche multiplication of charge carriers as described in Netherlands patent application No. 7905470 in which the emitting p-n junction extends parallel to the major surface and is separated therefrom by a thin n-type surface zone, it is possible that as a result of said gradual etching the said surface zone disappears entirely so that the cathode no longer functions. In a similar type of cold cathode, as described in Netherlands patent application No. 7800987 laid open to public inspection on July 31, 1979, the p-n junction is exposed at the major surface of the semiconductor body. As a result of the above-described damaging action of positive ions present in the electron tube, for example, the place where the p-n junction is exposed at the major surface may vary. This causes an unstable emission behavior.

In the second type of cathode-ray tube in which in the semiconductor cathode a p-n junction is operated in the forward direction, the so-called negative electron affinity cathode (NEA-cathode), the emission behavior is also influenced in that ion etching again takes place. In this case also, first the layer of electron work function-reducing material is gradually etched away. The p-type surface zone of the cathode is then attacked until the cathode no longer functions.

It has been found that the above-mentioned processes can occur so rapidly that the life of cathode-ray tubes manufactured with such semiconductor cathodes is considerably shortened hereby.

SUMMARY OF THE INVENTION

It is the object of the invention to provide a device of the kind mentioned in the opening paragraph in which the disadvantages are avoided entirely or partly in that the positive ions describe such a path that they do not impinge or hardly impinge on the emissive part of the cathode.

It is inter alia based on the recognition of the fact that an electrostatic field required for this purpose can be obtained in a simple manner by means of a simple extension of the semiconductor cathode.

It is furthermore based on the recognition of the fact that an oblique arrangement of the cathode with respect to the axis of the cathode-ray tube resulting from the use of such cathodes is of no influence or is hardly of influence on the capability of manufacturing the cathode-ray tube.

It is furthermore based on the recognition of the fact that the use of such a cathode in combination with conventional electrostatic deflection means results in a very simple construction of the cathode-ray tube.

The first mentioned type of device according to the invention (comprising a semiconductor cathode the p-n junction of which is operated in the reverse direction) is characterized in that the semiconductor body is covered at least partly with a second electrically insulating layer which does not cover the aperture in the first insulating layer and on which at least two deflection electrodes for generating a static dipole field are present.

It will be obvious that "dipole" is not to be considered a strictly mathematical dipole. A dipole field is to be understood to mean in this connection the electric field which occurs between two electrodes which are at different voltages.

As a result of this measure it is possible to create an electric field in the proximity of the semiconductor cathode in which the positive ions do not reach or hardly reach the emissive surface of the semiconductor body. In general these ions are generated at some distance from the semiconductor cathode in the vacuum tube, for example in that electrons, after having obtained sufficient energy in the high voltage part, experience interactions with residual gases remaining in the tube. When these ions reach the electric field generated by the deflection electrodes they thus have a higher kinetic energy than the electrons which are released at the surface of the semiconductor body. As a result of this difference in kinetic energy between the positive ions and the emanating electrons, the positive ions move along paths quite different from those of the electrons generated in the cathode. As a result of this the active surface of the cathode experiences substantially no detrimental influence of the positive ions.

The second type of device according to the invention equipped with so-called "negative electron affinity" cathodes is characterized in that the major surface is covered at least partly with an electrically insulating layer which does not cover at least a part of the p-type surface zone and on which at least two deflection electrodes are present for generating a static dipole field.

For such a device the same advantages apply as described above in connection with the first type of device.

A preferred embodiment of a device in accordance with the invention is characterized in that the normal to the major surface of the semiconductor body and the axis of the cathode-ray tube intersect each other at an acute angle.

The oblique arrangement of the cathode with respect to the anode which results herefrom hardly influences the generated electron beam. It has been found that the potential lines of the electric field generated by the deflection electrodes start extending parallel to the anode (display screen, target) soon. As a result of this the emanating beam can be directed in a simple manner with respect to the axis of the cathode-ray tube. This beam may then be controlled in a generally known manner by means of electron optics.

Another preferred embodiment of a device in accordance with the invention is characterized in that the cathode is provided so as to be eccentric with respect to the axis of the cathode-ray tube with its major surface substantially perpendicular to the direction of the axis of the cathode-ray tube, while the cathode-ray tube comprises electronoptical deflection means to deflect an electron beam generated by the cathode and deflected by the deflection electrodes in such manner as to subsequently move along the axis of the cathode-ray tube.

This embodiment has the advantage that the cathode can be connected in the end wall of the cathode-ray tube in a simple manner.

There exist several possibilities for the semiconductor cathodes to be used. For example, a cathode as described above, based on avalanche breakdown of a p-n junction may be used. A first type of this semiconductor cathode is characterized in that the p-n junction, at least within the aperture in the first electrically insulating layer, extends substantially parallel to the major surface of the semiconductor body and, within the aperture, locally shows a lower breakdown voltage than the remaining part of the p-n junction, the part of the p-n junction having the lower breakdown voltage being separated from the major surface by an n-type semiconductor zone having such a thickness and doping that at the breakdown voltage the depletion zone of the p-n junction does not extend up to the surface but remains separated therefrom by a surface layer which is sufficiently thin to pass the generated electrons.

A second type of semiconductor cathode based on avalanche breakdown and suitable for use in a cathode-ray tube in accordance with the invention is characterized in that at least in the operating condition at least a part of the depletion layer belonging to the p-n junction is exposed at the semiconductor surface within the aperture in the first electrically insulating layer.

In addition, the use of other semiconductor cathodes, for example the already-mentioned negative electron affinity cathode, is also possible.

BRIEF DESCRIPTION OF THE DRAWING

The invention will now be described in greater detail with reference to a few examples and the drawing, in which.

Figure 1:
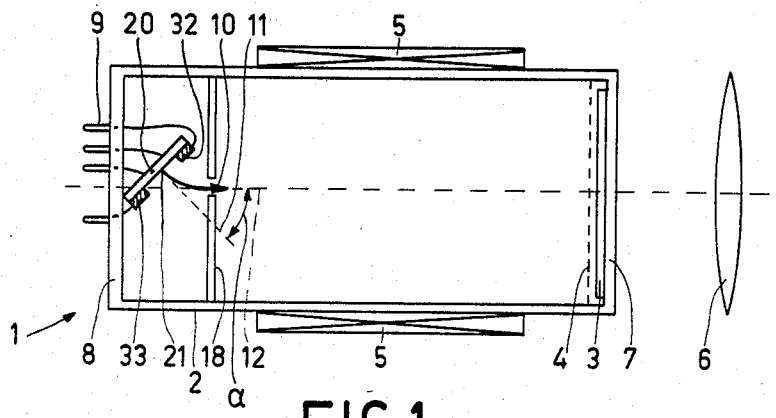
FIG. 1 shows diagrammatically a pick-up tube having a cathode-ray tube according to the invention.

The Figures are not drawn to scale and in the cross-sectional views in particular the dimensions in the direction of thickness are considerably exaggerated for clarity. Semiconductor zones of the same conductivity type are generally shaded in the same direction; in the Figures corresponding parts are generally referred to by the same reference numerals.

DESCRIPTION OF THE PREFERRED EMBODIMENTS

FIG. 1 shows diagrammatically a cathode-ray tube 1 according to the invention for use in a pick-up device. The pick-up tube 1 comprises in a hermetically sealed vacuum tube 2 a photoconductive target 3 and a screen grid 4. During operation the target 3 is scanned by means of an electron beam 10 generated by a semiconductor cathode 20. In order to be able to deflect said beam, the pick-up tube 1 furthermore comprises a system of coils 5.

A scene to be picked up is projected on the target 3 by means of the lens 6, the end wall 7 of the vacuum tube 2 being transparent to radiation. In behalf of electric connections the end wall 8 of the vacuum tube 2 comprises leadthroughs 9. In this example the semiconductor cathode 20 is assembled obliquely with respect to the end wall 8. This may be done, for example, by an assembly on a wedge-shaped base plate.

The angle $\alpha$ between the normal 11 to the major surface 21 of the cathode 20 and the axis 12 of the cathode-ray tube 1 in this example is 45°. Dependent on the voltages used and the geometry of the electrodes of the semiconductor cathode, a different angle may be chosen.

The semiconductor cathode 20, the construction of which will be described hereinafter in detail, comprises two deflection electrodes 32, 33. These deflection electrodes are separated from the remaining part of the semiconductor cathode by an electrically insulating layer of, for example, silicon oxide. When applying potentials which differ from each other to said deflection electrodes 32, 33, the electric field generated hereby will deflect the path of the electrons which leave the semiconductor body from the major surface 21. If, as in the present example, the electrode 32 is positive with respect to the electrode 31, the emanating electron beam 10 will be deflected in the direction of the deflection electrode 32.

It has been found that with a suitable choice of the angle $\alpha$ and of the potentials at the deflection electrodes 32, 33, the associated equipotential lines extend parallel to the end wall 7 of the vacuum tube 1 at a small distance from the cathode. By a correct positioning of the semiconductor cathode 20 relative to the axis 12 of the cathode-ray tube it is thus possible to center the beam 10 along said axis 12 before it experiences the influence of the system of coils 5. The pick-up tube furthermore comprises a grid 18 which serves as a diaphragm.

Figure 2:
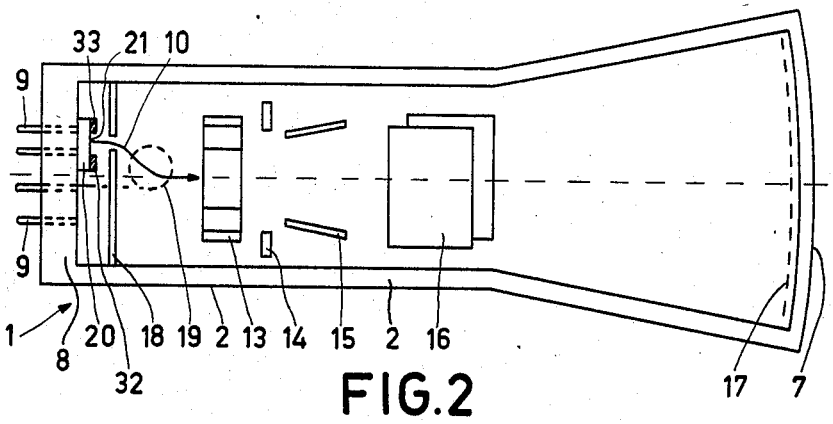
FIG. 2 shows diagrammatically a display tube having a cathode-ray tube according to the invention.

FIG. 2 shows a cathode ray tube 1 which serves as a display tube. The hermetically sealed vacuum tube 2 ends into a funnel shape, the end wall 7 being coated on its inside with a fluorescent screen 17. The tube furthermore comprises focusing electrodes 13, 14 and deflections plates 15, 16. The electron beam 10 is generated in a semiconductor cathode 20 which is mounted on the end wall 8 of the tube either directly or by means of a holder. Electric connections of the cathode are again led out via leadthroughs 9.

In this example the semiconductor cathode 20 is mounted eccentrically on the end wall 8 of the tube 2. An emanating electron beam 10 is deflected in the direction of the axis 12 of the cathode-ray tube by the electric field generated by the voltages applied to the deflection electrodes 32 and 33. The electron beam is then deflected back by means of a magnetic field in such manner as to move substantially along the axis of the cathode-ray tube. The beam 10, after having been focused by means of the focusing electrodes 13, 14, is then further controlled by means of the deflection plates 15, 16. The cathode-ray tube furthermore again comprises a grid 18 (diaphragm).

The magnetic field which deflects the electron beam back can be generated inter alia by means of coils, shown diagrammatically in FIG. 2 by means of the broken-line circle 19. The coils may be mounted inside or outside the tube 2 at will. In case of the assembly on the inside of the tube 2 the connections for said coils are also provided with electric connections via leadthroughs 9 in the end wall 8.

Figure 3:
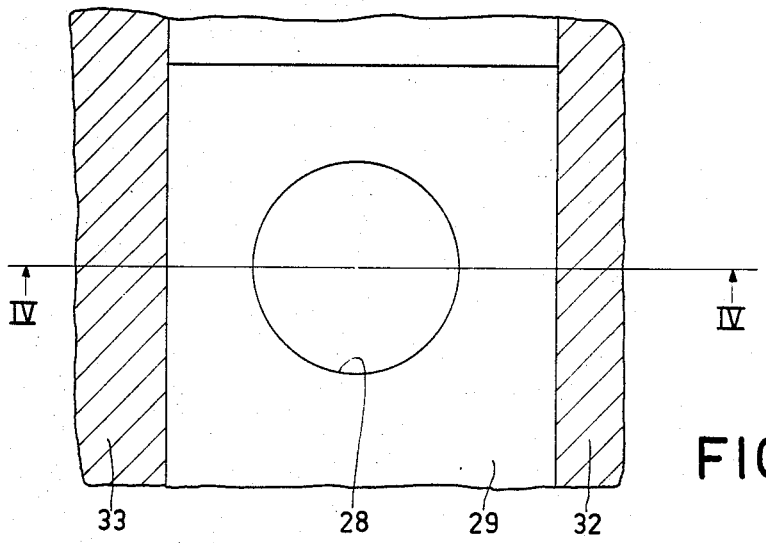
FIG. 3 is a diagrammatic plan view of a semi-conductor cathode for use in a cathode-ray tube according to the invention.
Figure 4:
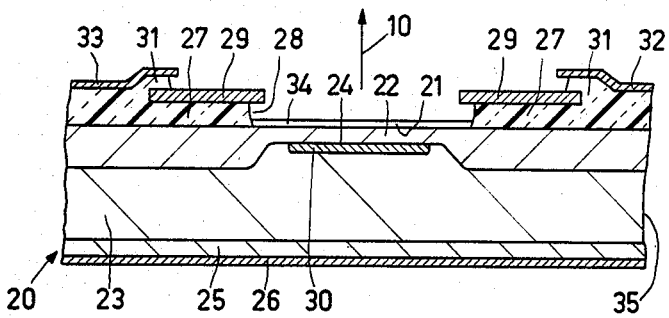
FIG. 4 is a diagrammatic cross-sectional view taken on the line IV—IV in FIG. 3.

FIGS. 3 and 4 show the semiconductor cathode used. It comprises a semiconductor body 35, in this example of silicon. The semiconductor body comprises an n-type surface region 22 which is generated at the major surface 21 of the semiconductor body and which forms a p-n junction 24 with a p-type region 23. By applying a sufficiently high voltage in the reverse direction across said p-n junction 24, electrons are generated by avalanche multiplication and can emanate from the semiconductor body. This is indicated in the Figures by means of arrow 10.

The semiconductor device furthermore comprises a connection electrode, not shown, with which the n-type surface region 22 is contacted. The p-type region 23 in this example is contacted on its lower side by a metallization layer 26. This contacting preferably takes place via a highly doped p-type contact zone 25.

In the Fig. 3 embodiment the donor concentration in the n-type region 22 at the surface is, for example, $5\times10^{18}$ atoms/cm$^3$, while the acceptor concentration in the p-type region 23 is much lower, for example $10^{15}$ atoms/cm$^3$. In order to reduce the breakdown voltage of the p-n junction 24 locally, the semiconductor device comprises a more highly doped p-type region 30 which forms a p-n junction with the n-type region 22. This p-type region 30 is situated within an aperture 28 in a first insulating material, (comma) layer 27, on which an accelerating electrode 29 of poly-crystalline silicon is provided around the aperture 28. If desired, the emission of electrons can be increased by covering the semiconductor surface 21 within the aperture 28 with a work function-reducing material, for example, with a layer 34 of a material comprising barium or caesium. For further details of such a semiconductor cathode and the manufacture thereof reference is made to applicants' Netherlands patent application No. 7905470 laid open to public inspection on Jan. 15, 1981 the contents of which are incorporated in this application by reference.

Figure 5:
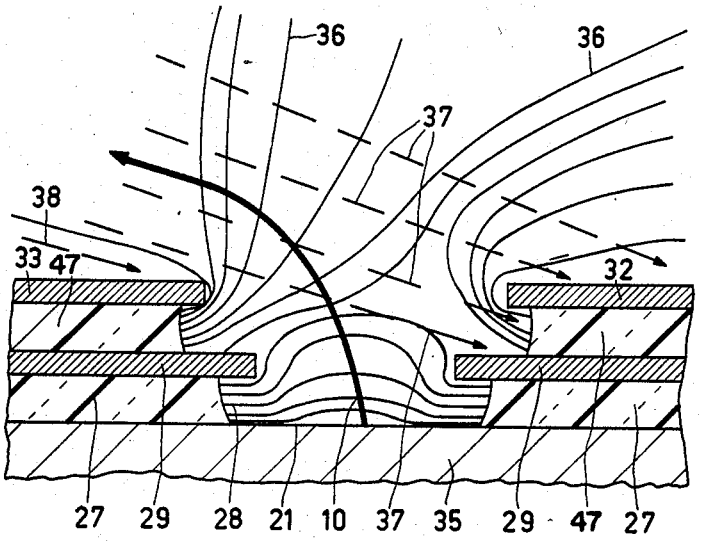
FIG. 5 shows diagrammatically the variation of the potential lines as they are generated in the operating condition by voltages at the accelerating electrodes and the deflection electrodes.

The semiconductor body 35 furthermore comprises additional insulating material 31 on which two deflection electrodes 32, 33 are present, for example, of aluminum. By means of these deflection electrodes and the accelerating electrode 29 and electric field is generated in the operating condition near the semiconductor surface. FIG. 5 shows diagrammatically potential lines 36 associated with such an electric field in which a first insulating layer 27 having therein an aperture 28 is provided on a semiconductor body 35. An accelerating electrode 29 is present on the insulating layer 27 at the edge of the aperture 28. Moreover, two deflection electrodes 32, 33 are shown which are separated from the accelerating electrode by additional insulating material 47. In the present embodiment the electric field lines 36 are shown for the case in which a voltage of 5 Volts is set up at the accelerating electrode 29, while voltages of 0 Volt and 20 Volts, respectively, are set up at the deflection electrodes 32 and 33, respectively.

Electrons released at the major surface 21 follow the path indicated by means of the arrow 10 under the influence of the prevailing electric field. As described above, said electron path is deflected under the influence of electric voltages on the electrodes 32 and 33. A number of positive ions which may be generated in the vacuum tube 2 by collision of the generated and accelerated electrons with residual gases and electrodes are accelerated in the direction of the cathode by the prevailing electric fields.

These positive ions reach the electric field near the cathode, for example, along the paths 37, 38 indicated in broken lines in FIG. 5. Since they have often traversed a part of the accelerating field of the cathode-ray tube, their kinetic energy generally is very large. As a result of this, these ions generally have a high kinetic energy when they reach the electric field of the cathode shown in FIG. 5 by means of the potential lines 36. Although they experience the influence of the associated electric force, only a small path curvature will occur due to their high kinetic energy as is shown diagrammatically in FIG. 5 by the variation of the broken lines 37, 38. A result thereof is that substantially no or only very few positive ions can reach the emissive semiconductor surface. Therefore the cathode will experience hardly any degradation effects as a result of etching or other damaging action by positive ions.

In the sample shown the semiconductor body comprises only one semiconductor cathode having one aperture 28. In other devices this number may be extended; for example, for color television applications three or more apertures 28 may be provided at the area of individually-controllable cathodes, which comprise common deflection electrodes and a common accelerating electrode.

Figure 6:
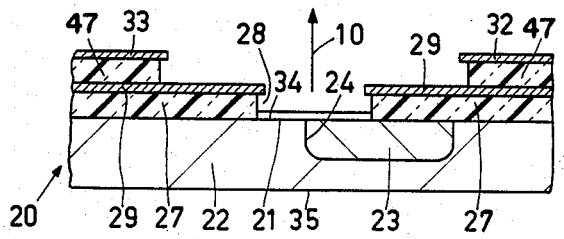
FIG. 6 is a diagrammatic cross-sectional view of another semiconductor cathode.

FIG. 6 is a cross-sectional view of another embodiment of a semiconductor cathode 20 based on avalanche breakdown of a p-n junction. In this embodiment the semiconductor body 35 comprises an n-type substrate 22 in which a p-type surface region 23 is present. As a result of this, a p-n junction 24 which adjoins the major surface 21 is formed, the associated depletion zone of which is exposed at the semiconductor surface. This surface 21 furthermore comprises first electrically insulating material, layer 27, for example, of silicon oxide. In this layer 27 at least one aperture 28 is provided within which at least a part of the p-n junction 24 adjoins the major surface 21 of the semiconductor body. Furthermore, an accelerating electrode 29 which in this example is of aluminum is provided on the electrically insulating layer 27 at the edge of the aperture 28 in the immediate proximity of the p-n junction 24. The semiconductor device furthermore comprises connection electrodes not shown which are connected to the n-type substrate 22, if desired via a highly doped contact zone, and to the p-type surface region 23. If desired, the semiconductor surface 21 within the aperture 28 may again be covered with a layer 34 of a work function-reducing material. For further details of such a semiconductor cathode and its way of manufacture reference is made to applicants' Netherlands patent application No. 7800987 laid open to public inspection on July 31, 1979, the contents of which are assumed to be incorporated in this application by reference.

The deflection electrodes 32, 33 in FIGS. 3, 4, 6 may be provided, for example, by means of a liftoff technique. After the semiconductor cathodes have been manufactured as described in the Netherlands patent applications No. 7905470 and No. 7800987, the whole surface is covered, for example, with a photolacquer which is then removed at the area of the electrodes to be formed. The assembly is then covered with a layer of aluminum. The photolacquer layer with the aluminum deposited thereon is then removed so that aluminum remains only at the area of the deflection electrodes 32, 33 and connection tracks, if any.

In another method the semiconductor body is covered with an insulating layer which can be deposited both thermally and from the vapor phase. This layer may consist of silicon oxide and/or silicon nitride on which metal is vapor-deposited which is patterned by means of photolithographic techniques, after which the insulating layer is removed by means of known etching methods while covering the metal at the area of the apertures 28 to be formed.

The cathode again comprises additional electrically insulating material, layer 47 on which deflection electrodes 32 and 33 are present. Again such voltages may be set up at said deflection electrodes 32, 33 and the accelerating electrode 29 that the associated electric field exerts a similar influence on positive ions present in the vacuum tube 2 as described above with reference to FIG. 5 for the cathode of FIG. 3.

Figure 7:
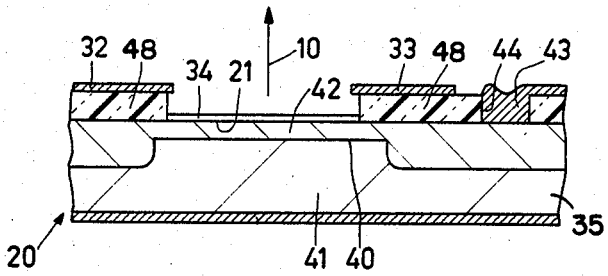
FIG. 7 is a diagrammatic cross-sectional view of still another semi-conductor cathode for use in a cathode-ray tube according to the invention.

FIG. 7 finally shows the cross-sectional view of a cathode of the negative electron affinity type (NEA-cathode), in which a p-n junction is operative in the forward direction. In this example, the semiconductor cathode 20 comprises an n-type semiconductor body 41, for example of gallium arsenide, with a concentration of $10^{17}$ donors/cm$^3$ and a thickness of 0.5 millimeter. Present at a major surface 21 is a part 42 of p-type conductivity having a thickness of approximately 10 micrometers and a surface concentration exceeding $10^{19}$ acceptor atoms/cm$^3$. The p-type part 42 is covered with a coating 34 of electron work function-reducing material and has two electric connections. One of these two electric connections in an injection connection which in this case is formed by a metallization layer 35, semiconductor body 41 and the p-n junction 40 between the p-type surface part 42 and the n-type body 41. The other connection 43 contacts the p-type part 42 via a contact window 44 in an electrically insulating layer 31. The operation and manufacture of such a cathode is described in greater detail in applicants' granted Netherlands patent specification No. 150609 the contents of which are deemed to be incorporated in this application by reference.

Deflection electrodes 32 and 33 are present on the electrically insulating material, layer 48. Herewith an electric field can be generated of such a shape that in a manner similar to that described above with reference to FIGS. 4 and 5, positive ions which are accelerated in the direction of the semiconductor cathode 20 do not impinge or hardly impinge on the emissive surface.

It will be apparent that the invention is not restricted to the above-described examples but that many variations are possible to those skilled in the art without departing from the scope of this invention. For example, as already indicated in the FIG. 4 embodiment, the number of apertures 28 in the insulating layer where separately controllable emission occurs may also be extended to three in the FIG. 7 device for color television applications.

Instead of mounting the cathode obliquely as shown in FIG. 1, an oblique rear wall 8 may also be used. The semiconductor cathode itself may moreover be manufactured in various other manners, as described in the abovementioned Netherlands patent applications.

For the shape of the deflection electrodes many variations are also possible. This may prevent advantages in avoiding deflection errors. If desired, a split pattern may also be chosen for one of the deflection electrodes (or for both), whereby the split parts are electrically connected as to maintain the dipole field.

What is claimed is:

1. A device for recording or displaying pictures, comprising an elongated cathode-ray tube with an elongated axis and having, in an evacuated envelope, a target and a semiconductor cathode having a semiconductor body with a major surface on which a first electrically insulating material layer having at least one aperture is provided, which semiconductor body comprises at least a p-n junction in which the application of voltage in the reverse direction across the p-n junction causes electrons to be generated in the semiconductor body by avalanche multiplication, said electrons emanating from the semiconductor body at the area of the aperture in the first electrically insulating material, and in which at least an accelerating electrode is provided on the first electrically insulating material at least at the area of the edge of the aperture in said layer, wherein the improvement comprises additional electrically-insulating material covering at least part of the semiconductor body other than said aperture in the first insulating material, said additional electrically insulating material having at least two deflection electrodes on it for generating a static dipole field.

2. A device for recording or displaying pictures comprising an elongated cathode-ray tube with an elongated axis and having, in an evacuated envelope, a target and a semiconductor cathode comprising a semiconductor body having a major surface, a p-type surface zone at said major surface and comprising at least two connections of which at least one comprises an injecting connection at a distance from the major surface which is smaller than the diffusion recombination length of electrons in the p-type surface zone, characterized in that the major surface is covered at least partly with an electrically insulating layer which leaves at least a part of the p-type surface zone uncovered, at least two deflection electrodes being provided on said electrically insulating layer for generating a static dipole field.

3. A device as claimed in claim 1 or 2, characterized in that a normal to the major surface of the semiconductor body and the axis of the cathode-ray tube intersect each other at an acute angle.

4. A device as claimed in claim 1 or 2, characterized in that the semiconductor cathode is provided so as to be eccentric with respect to the axis of the cathode-ray tube with its major surface substantially perpendicular to the axis direction of the cathode-ray tube, while the cathode-ray tube comprises electron optical deflection means to deflect an electron beam generated by the cathode and deflected by the deflection electrodes in such manner as to then move along the axis of the cathode-ray tube.

5. A device as claimed in claim 1, characterized in that the p-n junction, at least within the aperture in the first electrically insulating layer, extends substantially parallel to the major surface of the semiconductor body and, within the aperture, locally shows a lower breakdown voltage than the remaining part of the p-n junction, the part of the p-n junction having the lower breakdown voltage being separated from the major surface by an n-type semiconductor zone having such a thickness and doping that at the breakdown voltage the depletion zone of the p-n junction does not extend up to the surface but remains separated therefrom by a surface layer which is sufficiently thin to let the generated electrons transverse this surface layer.

6. A device as claimed in claim 1, characterized in that at least in the operating condition at least a part of the depletion layer associated with the p-n junction is exposed at the semiconductor surface within the aperture in the first electrically insulating layer.

7. A device as claimed in claim 1, characterized in that the device comprises several independently adjustable p-n junctions in which electrons can be generated and is provided with an accelerating electrode and deflection electrodes which are common to the apertures associated with said p-n junction.

8. A device as claimed in claim 1, characterized in that the major surface of the semiconductor body, at least within the aperture in the first electrically insulating layer, is covered with an electron work function-reducing material.

9. A device as claimed in claim 1, wherein said semiconductor body has a major surface on which a first electrically insulating layer having an aperture is provided, which semiconductor body comprises at least a p-n junction in which by applying a reverse voltage across the p-n junction electrons can be generated in the semiconductor body by avalanche multiplication which at the area of the aperture in the first electrically insulating layer emanate from the semiconductor body and in which at least an accelerating electrode is present on the first electrically insulating layer at least at the area of the edge of the aperture in said layer, characterized in that the semiconductor body is covered at least partly with a second electrically insulating layer which does not cover the aperture in the first electrically insulating layer and on which at least two deflection electrodes are present.

10. A device as claimed in claim 9, characterized in that the p-n junction, at least within the aperture in the first electrically insulating layer, extends substantially parallel to the major surface of the semiconductor body and, within the aperture, locally shows a lower breakdown voltage than the remaining part of the p-n junction, the part of the p-n junction of lower breakdown voltage being separated from the major surface by an n-type semiconductor zone having such a thickness and doping that at the breakdown voltage the depletion zone of the p-n junction does not extend up to the surface but remains separated therefrom by a surface layer which is sufficiently thin to pass the generated electrons.

11. A device as claimed in claim 9, characterized in that at least in the operating condition at least a part of the depletion layer associated with the p-n junction is exposed at the semiconductor surface within the paperture in the first electrically insulating layer.

12. A device as claimed in claim 2, wherein said semiconductor body has at a major surface, a p-type surface zone comprising at least two connections of which at least one is an injecting connection at a distance from the major surface which is at least equal to the diffusion-recombination length of electrons in the p-type surface zone, characterized in that the major surface is covered at least partly with an electrically insulating layer which does not cover at least a part of the p-type surface zone and on which at least two deflection electrodes are present.

13. A device as claimed in claim 8, characterized in that the electron work function-reducing material comprises a material selected from the group consisting of caesium and barium.

* * * * *

UNITED STATES PATENT AND TRADEMARK OFFICE

CERTIFICATE OF CORRECTION

PATENT NO. : 4,574,216

DATED : March 4, 1986

INVENTOR(S) : ARTHUR M. E. HOEBERECHTS ET AL

It is certified that error appears in the above-identified patent and that said Letters Patent is hereby corrected as shown below:

IN THE CLAIMS:

Claim 11, line 4, change "paper-" to -- aper- --.

Signed and Sealed this

Second Day of December, 1986

*Attest:*

DONALD J. QUIGG

*Attesting Officer*

*Commissioner of Patents and Trademarks*